US009086206B2

(12) United States Patent
Namors

(10) Patent No.: US 9,086,206 B2
(45) Date of Patent: Jul. 21, 2015

(54) WIDE-RANGE PORTABLE ILLUMINATION DEVICE

(71) Applicant: Richard A. Namors, Custer, MI (US)

(72) Inventor: Richard A. Namors, Custer, MI (US)

( * ) Notice: Subject to any disclaimer, the term of this patent is extended or adjusted under 35 U.S.C. 154(b) by 0 days.

(21) Appl. No.: 14/170,069

(22) Filed: Jan. 31, 2014

(65) Prior Publication Data

US 2014/0321107 A1 Oct. 30, 2014

Related U.S. Application Data

(60) Provisional application No. 61/815,915, filed on Apr. 25, 2013.

(51) Int. Cl.

| | |
|---|---|
| ***F21L 4/02*** | (2006.01) |
| ***F21V 7/04*** | (2006.01) |
| ***F21V 9/08*** | (2006.01) |
| ***F21V 9/16*** | (2006.01) |
| ***F21V 21/06*** | (2006.01) |
| ***F21V 21/088*** | (2006.01) |
| *F21Y 101/02* | (2006.01) |
| *F21Y 111/00* | (2006.01) |

(52) U.S. Cl.

CPC ..... *F21V 7/041* (2013.01); *F21L 4/025* (2013.01); *F21L 4/027* (2013.01); *F21V 9/083* (2013.01); *F21V 9/16* (2013.01); *F21V 21/06* (2013.01); *F21V 21/0885* (2013.01); *F21Y 2101/02* (2013.01); *F21Y 2111/004* (2013.01)

(58) Field of Classification Search

CPC ..... F21L 4/02; F21L 4/027; F21V 9/083

USPC ..... 362/184

See application file for complete search history.

(56) References Cited

U.S. PATENT DOCUMENTS

| | | | | |
|---|---|---|---|---|
| 1,744,370 | A * | 1/1930 | Dietz et al. | 362/241 |
| 2,716,700 | A * | 8/1955 | La France | 362/184 |
| 3,944,805 | A * | 3/1976 | Moore | 362/194 |
| 4,875,147 | A * | 10/1989 | Auer | 362/205 |
| 5,558,430 | A * | 9/1996 | Booty, Jr. | 362/184 |
| 6,179,431 | B1 * | 1/2001 | Chien | 362/84 |
| 8,047,680 | B2 * | 11/2011 | Huang et al. | 362/249.02 |
| 2003/0095408 | A1 * | 5/2003 | Opolka | 362/241 |
| 2008/0027674 | A1 * | 1/2008 | Sandy et al. | 702/160 |
| 2008/0030977 | A1 * | 2/2008 | Bobbin et al. | 362/106 |
| 2008/0304258 | A1 * | 12/2008 | McMillan et al. | 362/202 |
| 2012/0006950 | A1 * | 1/2012 | Vandiver | 248/176.3 |

* cited by examiner

*Primary Examiner* — Robert May
*Assistant Examiner* — Bryon T Gyllstrom

(57) ABSTRACT

A wide-range portable illumination device is an apparatus that produces a wide horizontal band of light in order to illuminate a wider scope of objects within the dark. The apparatus evenly distributes a plurality of illumination device along a circular arc. Each illumination device is physically separate from each other, which allows them to be arranged in a radially pattern along the circular arc. In addition, each illumination device includes an light emitting diode (LED) bulb and a pyramidal case. The LED bulb traverse into the apex of the pyramidal case and is centrally mounted within the pyramidal case. The pyramidal case has a plurality of lateral panels that surrounds the LED bulb. Each lateral panel has an inner reflective surface, which focuses the light emitted by the LED bulb in one direction. The apparatus also includes a housing, a portable power source, a switch, and an ergonomic handle.

19 Claims, 9 Drawing Sheets

WIDE-RANGE PORTABLE ILLUMINATION DEVICE

The current application claims a priority to the U.S. Provisional Patent application Ser. No. 61/815,915 filed on Apr. 25, 2013.

FIELD OF THE INVENTION

The present invention relates generally to the field of flashlights. More specifically, the present invention configures its illumination sources to form a wider band of light.

BACKGROUND OF THE INVENTION

Currently, an ordinary battery flashlight casts only a narrow beam of light that must shine directly on an object for it to be clearly seen. In order to see a wider scope, the flashlight has to be waved back and forth or be moved in a fanning motion. When this is done, only the area illuminated by the narrow beam of light is clear while the surrounding areas receive very little indirect/ambient/radiant light from the flashlight. Therefore, an objective of the present invention is to provide an apparatus that is capable of producing a wider beam of light than typical flashlights. The new and unique shape of the present invention can emit a wide band of light in an almost 180 degree arc, which is due to the curved, convex rectangular shape of the bulb's projective reflective shield. With this type of intense illumination and a projection field of up to 100 meters, a vast area can be instantly lighted and every object is clearly seen by the present invention.

DETAILED DESCRIPTIONS OF THE INVENTION

All illustrations of the drawings are for the purpose of describing selected versions of the present invention and are not intended to limit the scope of the present invention.

Figure 1:
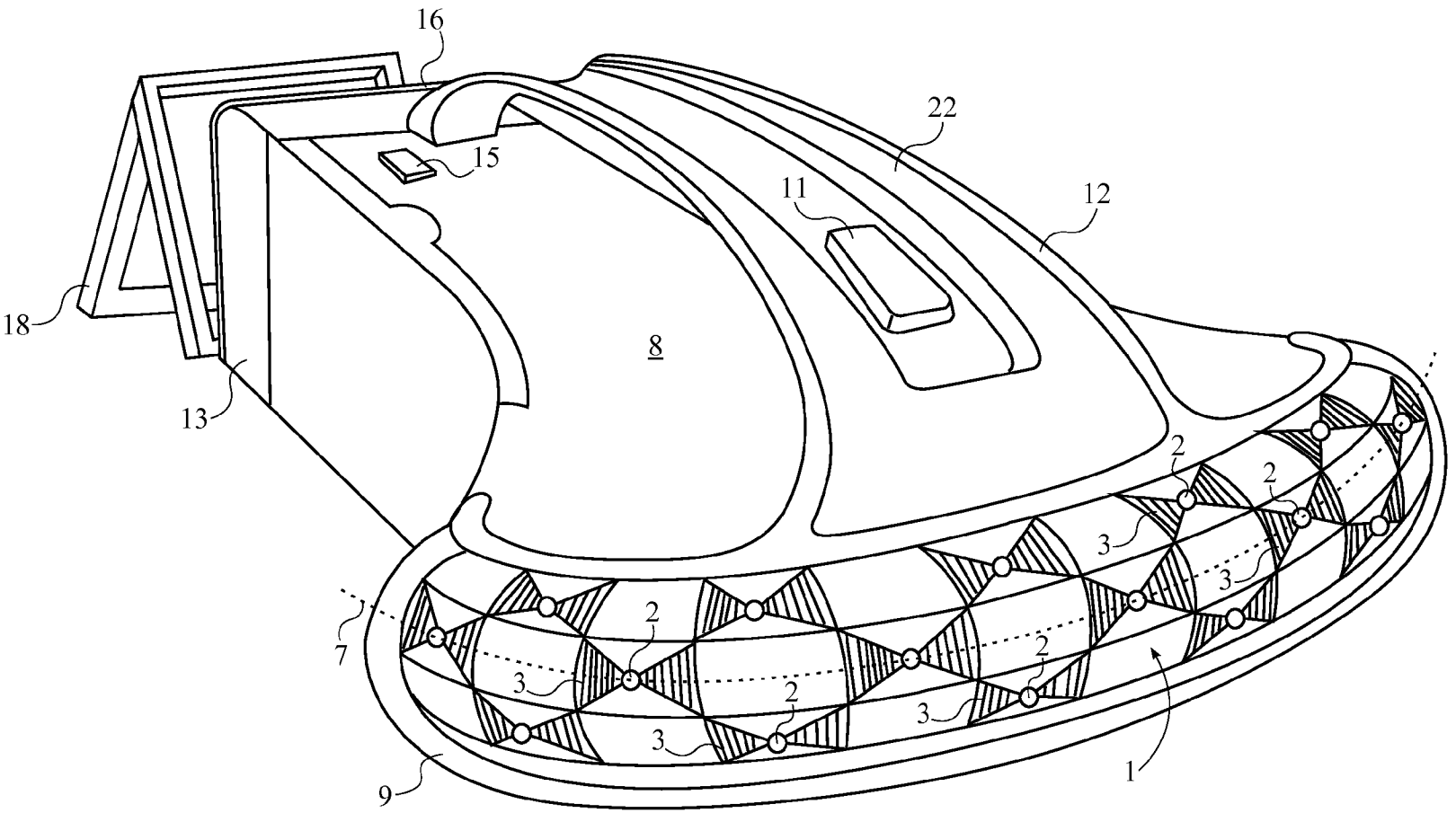
FIG. 1 is a front perspective view of the preferred embodiment of the present invention.

As can be seen in FIG. 1, the present invention is a wide-range portable illumination device, which is used to provide a radial band of light with a horizontal range of almost 180 degrees. The present invention mainly comprises a plurality of illumination devices 1, a housing 8, a portable power source 10, a transparent cover 9, and a primary switch 11. Each of the plurality of illumination devices 1 is capable of producing a single beam of light. The plurality of illumination devices 1 is physically separate objects and, thus, can be arranged along a wide band arc 7. The housing 8 is an enclosure that provides a base for all of the other components of the present invention. The housing 8 can be made of, but is not limited to, a heavy duty plastic. The portable power source 10 is used to electrically power the plurality of illumination devices 1, and the primary switch 11 is used to selectively break the electrical current traveling from the portable power source 10 to the plurality of illumination devices 1. In the preferred embodiment of the present invention, the portable power source 10 is at least one battery, and the primary switch 11 is a three-stage switch. For the three-stage switch, the first stage will only activate the central illumination devices along the wide band arc 7. The second stage will activate the central illumination devices and the illumination devices surrounding the central illumination devices. The third stage will activate the central illumination devices, the illumination devices surround the central illumination devices, and the most peripheral illumination devices along the wide band arc 7. The transparent cover 9 is used to shield the plurality of illumination devices 1 from any outside particulate. The transparent cover 9 can be made of, but is not limited to, a clear acrylic.

Figure 2:
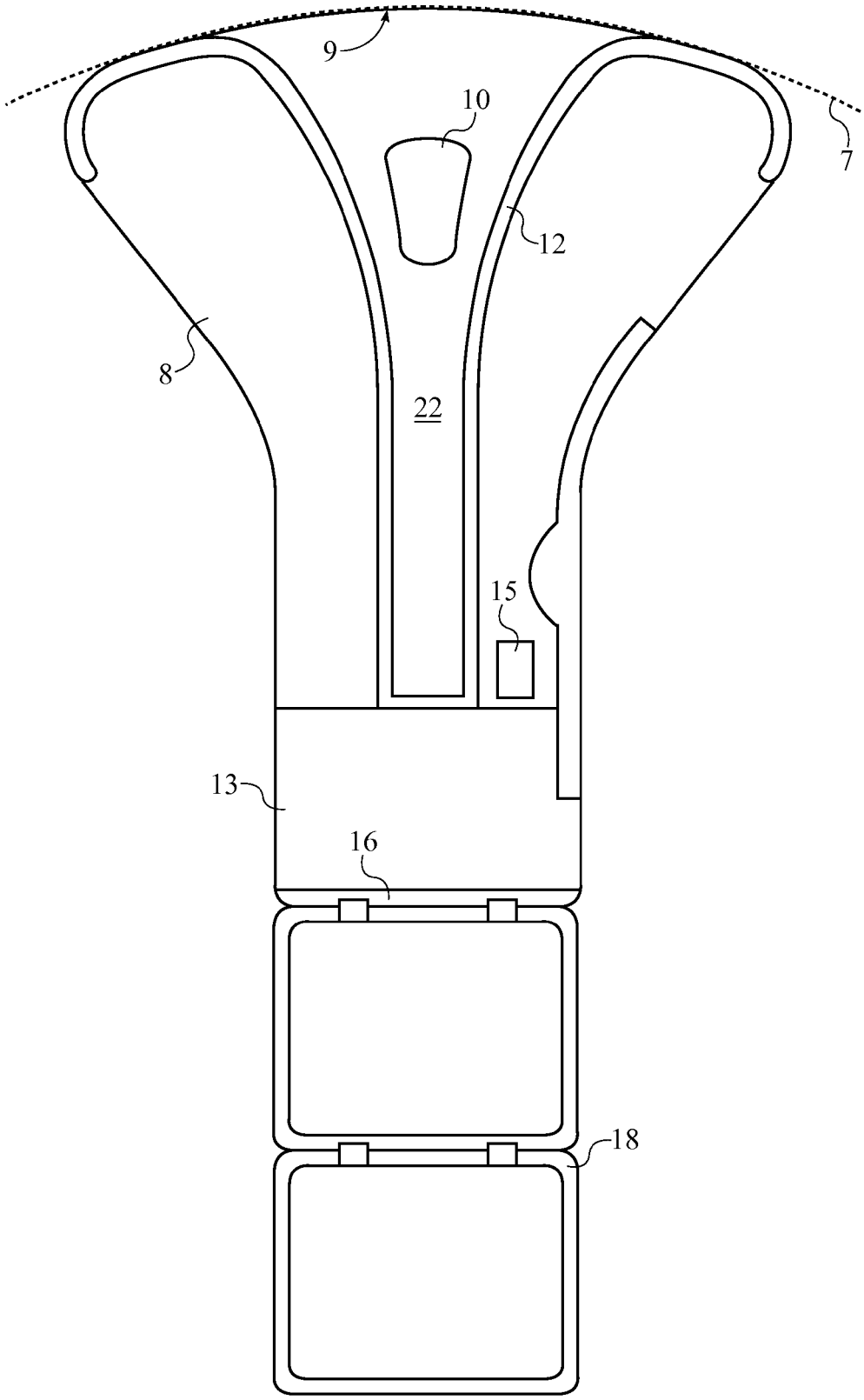
FIG. 2 is a top view of the preferred embodiment of the present invention.
Figure 3:
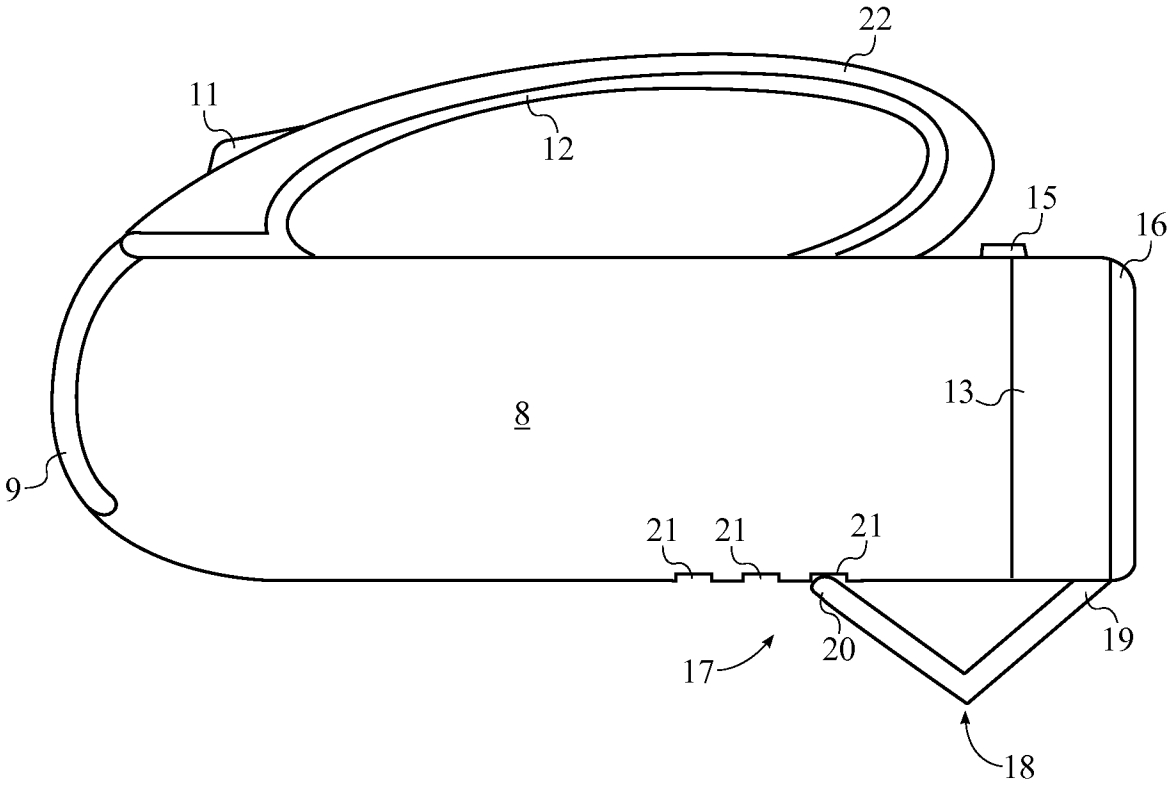
FIG. 3 is a side view of the preferred embodiment of the present invention.
Figure 4:
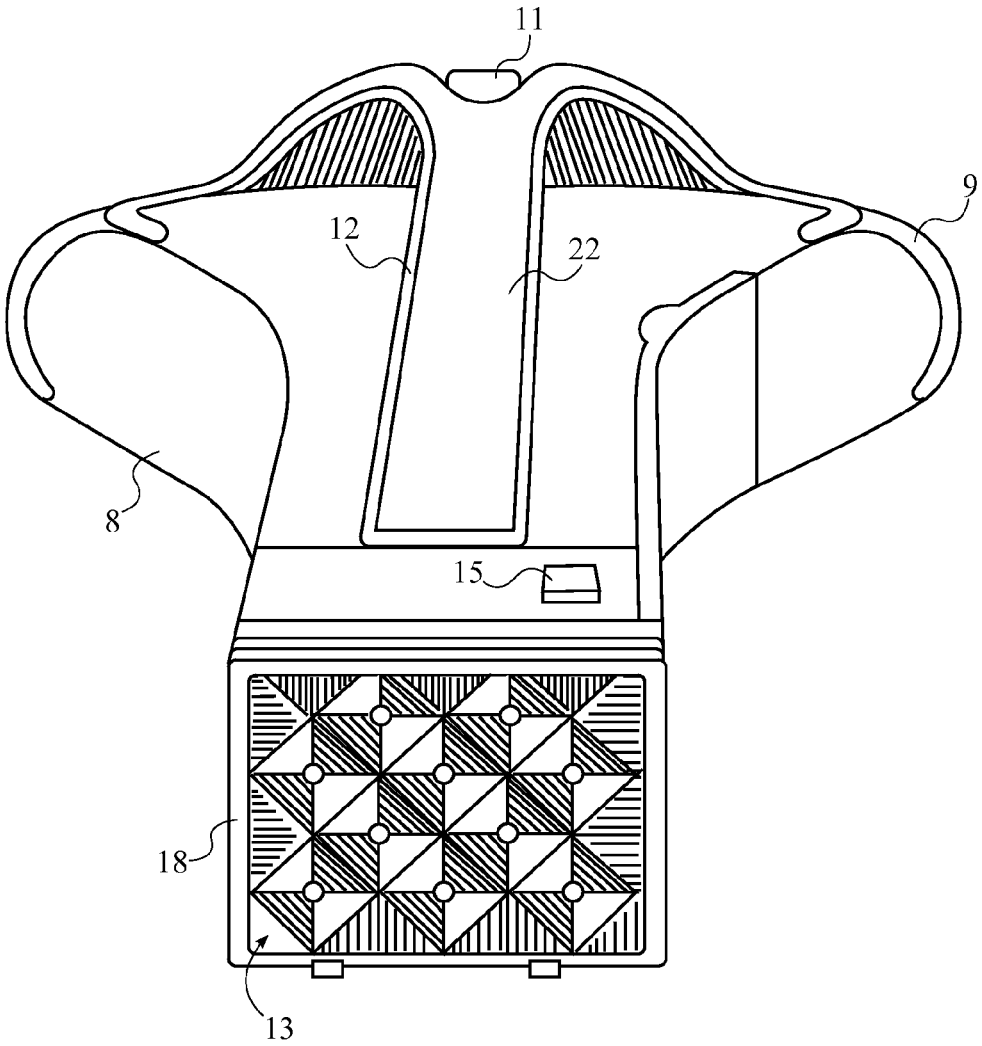
FIG. 4 is a rear perspective view of the preferred embodiment of the present invention.
Figure 6:
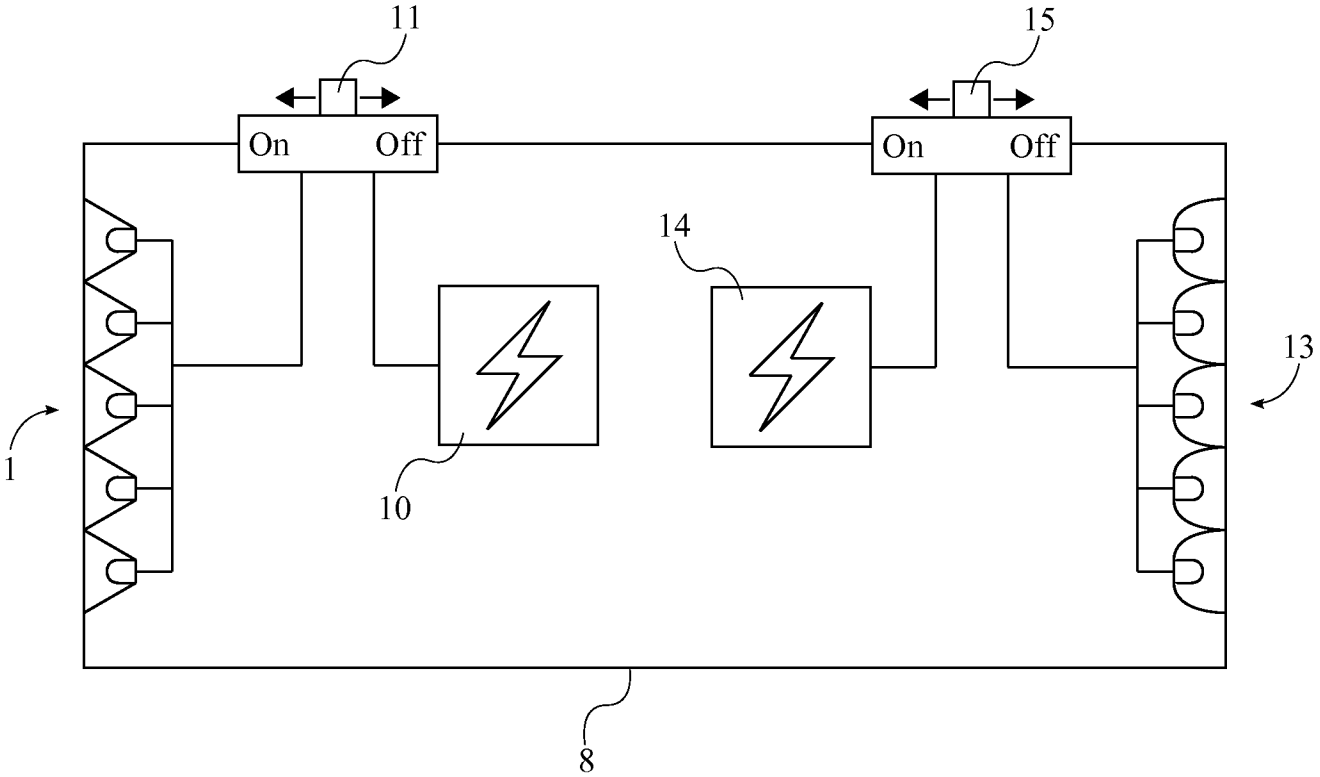
FIG. 6 is an electronic schematic of the preferred embodiment of the present invention.

As can be seen in FIGS. 2, 3, and 4, the general configuration of these components allows a user to efficiently and effectively handle the present invention. The wide band arc 7 is a circular line segment that is used to define the emission range for the radial band of light. The dimensions of the wide band arc 7 depend on the number of illumination devices 1 and the dimensions of each illumination device 1. Thus, the wide band arc 7 is positioned adjacent to the housing 8 so that the plurality of illumination devices 1 can be evenly distributed along the wide band arc 7. The plurality of illumination devices 1 is also mounted into the housing 8 in order to properly situate each illumination device 1 along the wide band arc 7. The transparent cover 9 is positioned across the plurality of illumination devices 1 as a means to protect the plurality of illumination devices 1 from any external damage. The portable power source 10 shown in FIG. 6 is positioned within the housing 8 and is electrically connected to the plurality of illumination devices 1 through the primary switch 11, which allows the housing 8 to protect all of the electrical connections for the present invention from any external damage. The primary switch 11 is operatively mounted into the housing 8 so that a user can move the primary switch 11 from the off position to the on position and vice versa.

Figure 5:
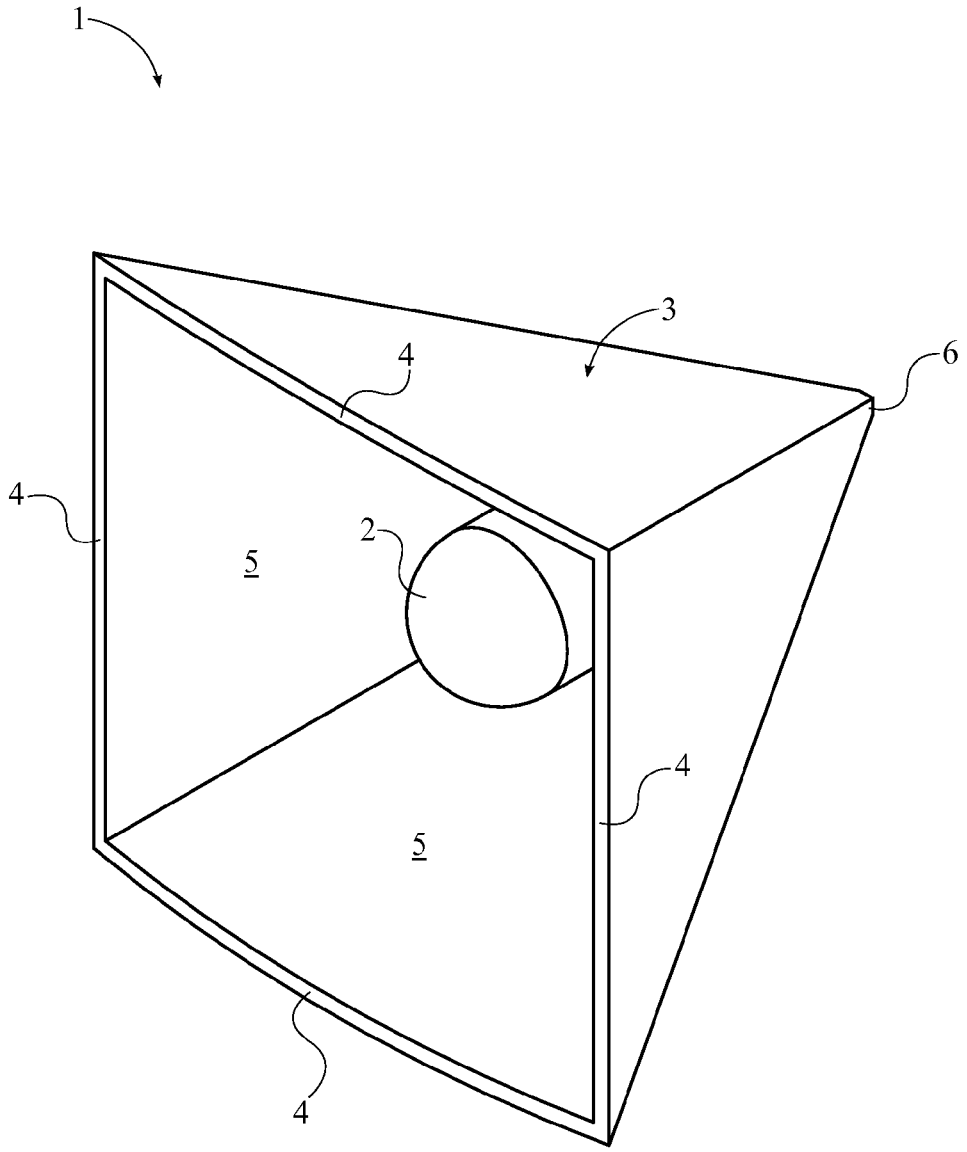
FIG. 5 is a magnified perspective view of an illumination device for the present invention.

In the preferred embodiment of the present invention, the plurality of illumination devices 1 has a specific configuration shown in FIG. 5 in order to better position and orient the plurality of illumination devices 1 along the wide band arc 7. Each of the plurality of illumination devices 1 comprises a light emitting diode (LED) bulb 2 and a pyramidal case 3. The LED bulb 2 is a low energy, efficiently sized device that is capable of producing the necessary light in one direction along the wide band arc 7. The pyramidal case 3 is used to enclose and support the LED bulb 2 and is used as a reflector for the LED bulb 2, which focuses the light from the LED bulb 2 in one direction. The pyramidal case 3 comprises a plurality of lateral panels 4 that are positioned about an apex 6. The LED bulb 2 traverses into the pyramidal case 3 through the apex 6 so that the plurality of lateral panels 4 is radially positioned around the LED bulb 2. This allows the LED bulb 2 to be surrounded by the inner reflective surface 5 for each lateral panel 4. The inner reflective surface 5 can be, but is not limited to, a silver Mylar reflective shielding.

As can be seen in FIGS. 2, 3, and 4, the preferred embodiment of the present invention is designed with a supplemental illumination device 13, which allows the present invention to be used as an emergency signal. The present invention could also include an at least one interchangeable transparent cover 16, which could further assist the present invention while being used as an emergency signal. The supplemental illumination device 13 provides the present invention with an auxiliary source of light other than the plurality of illumination devices 1. Thus, the supplemental illumination device 13 is mounted into the housing 8 opposite to the plurality of illumination devices 1. In some embodiments, the supplemental illumination device 13 utilizes the same componentry as the plurality of illumination devices 1. The interchangeable transparent cover 16 is positioned onto the supplemental illumination device 13 in order to protect the supplemental illumination device 13 from any external damage. The interchangeable transparent cover 16 has a colored tint, and multiple interchangeable transparent covers 16 could each have a different colored tint that would indicate the nature or the severity of an emergency. For example, an interchangeable transparent cover 16 with a red tint can be used to communicate a warning, and an interchangeable transparent cover 16 with a yellow tint can be used to communicate caution. Thus, the interchangeable transparent cover 16 is perimetrically attached to the housing 8 so that an interchangeable transparent cover 16 with one kind of colored tint can be detached from the housing 8 and be swapped out for another interchangeable transparent cover 16 with a different colored tint. The present invention also further comprises a supplemental power source 14 and a supplemental switch 15, which are respectively used to power the supplemental illumination device 13 and to selectively break the electrical current flowing into the supplemental illumination device 13. The supplemental power source 14 shown in FIG. 6 is positioned within the housing 8 and is electrically connected to the supplemental illumination device 13 through the supplemental switch 15. Similar to the primary switch 11, the supplemental switch 15 is bistably mounted into the housing 8 so that the user can move the supplemental switch 15 from the off position to the on position and vice versa. The supplemental power source 14 can be, but is not limited to, four AA batteries, and the supplemental switch 15 is located near the supplemental illumination device 13. The supplemental illumination device 13 and its corresponding components can be extremely helpful in case of mechanical problems with a vehicle, be helpful as a warning light to protect against approaching vehicles, and/or be helpful as a cautionary warning for pedestrians.

As can be seen in FIG. 3, the preferred embodiment of the present invention is also designed with a kickstand 17, which is used to prop up the present invention at an angle. The kickstand 17 comprises a collapsible member 18 and a plurality of notches 21. If the kickstand 17 is not being used, then the collapsible member 18 is straightened out so that the collapsible member 18 can be efficiently stored into the present invention. If the kickstand 17 is being used, then the collapsible member 18 is bent into a protruding shape in order to prop up one side of the present invention at an angle. The collapsible member 18 can be designed as a ring so that the collapsible member 18 can also be used to hang the present invention. The first end 19 of the collapsible member 18 is hingedly connected to the housing 8, and the second end 20 of the collapsible member 18 is used to engage one from the plurality of notches 21, which are recessed spaces that traverse into the housing 8. The plurality of notches 21 is serially positioned to each other and is adjacent to the first end 19 of the collapsible member 18, which allows the second end 20 to engage any of the notches 21 and configures the kickstand 17 to prop the present invention at the desired angle.

In different embodiments, the present invention could include a few ancillary components that would provide the present invention with additional functionalities. One such ancillary component is a grasping member 22, which allows a user to firmly hold and aim the present invention. The grasping member 22 could be, but is not limited to, a handle or a kind of strap assembly. Either way, the grasping member 22 is externally connected to the housing 8. Another such ancillary component is an at least one phosphorescent strip 12, which glows in the absence of light. The at least one phosphorescent strip 12 allows a user to locate the present invention during a blackout. Thus, the phosphorescent strip 12 should be externally positioned onto the housing 8. Another such ancillary component is a pocket clip 23, which allows the present invention to be comfortably attached to a user's clothing. For example, the pocket clip 23 could be used to attach the present invention to a shoulder strap, a pocket, or a sleeve so that the user does not have to continuously hold the present invention. Thus, the pocket clip 23 is externally connected to the housing 8. Another such ancillary component is a hanging loop 24, which is a means to loosely suspend the present invention. For example, the hanging loop 24 can be used to suspend the present invention to a user's clothing or from a memorable location for the user so that the present invention is readily available to the user. Thus, the hanging loop 24 is externally linked to the housing 8. The handing loop can be, but is not limited to, a rigid ring or a looped strap.

The preferred embodiment of the present invention is configured and shaped to be a typical lantern. For the preferred embodiment, the wide band arc 7 is 170 degrees, which allows a wide area of space to be completely and instantly illuminated by the present invention and allows objects to be very clearly seen with the present invention. Also for this embodiment, the grasping member 22 is a handle, which is ergonomically designed with an indented thumb rest that runs through three-fourths of the handle. The primary switch 11 is located within the indented thumb rest. The plurality of illumination devices 1 for this embodiment includes sixteen illumination devices and is arranged in a top row of five, a middle row of six, and a bottom row of five along the wide band arc 7. The top row and the bottom row are angled outwards in a direction perpendicular to the wide band arc 7 in order to increase the vertical width of the radial band of light produced by the present invention. Another configuration for the plurality of illumination devices 1 in this embodiment is a single row of eleven illumination devices that are arranged along the wide band arc 7. The portable power source 10 for this embodiment is a 6-volt battery.

Figure 7:
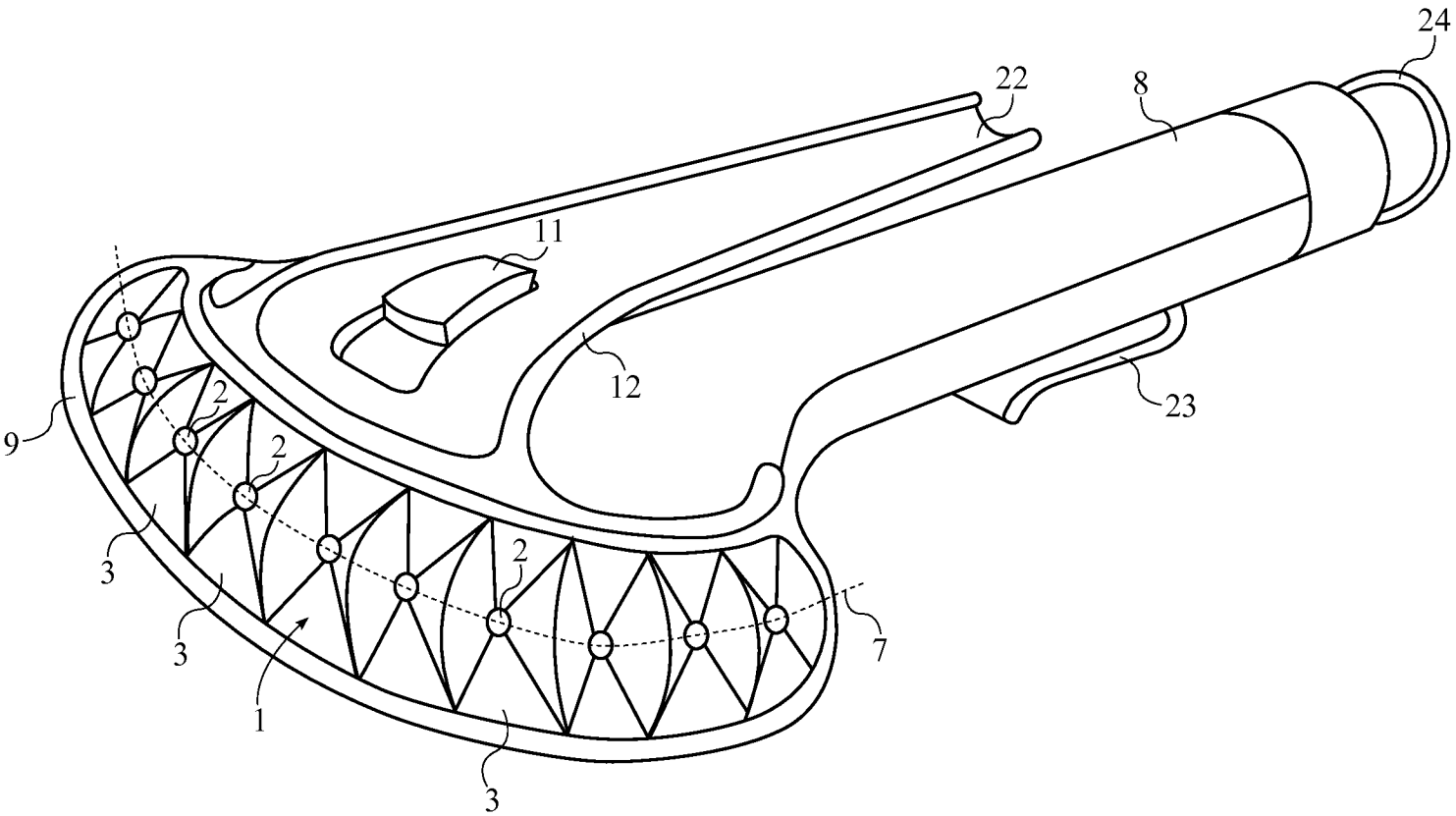
FIG. 7 is a perspective view of the industrial-flashlight embodiment of the present invention.

In one embodiment, the present invention is configured and shaped to be an industrial flashlight, which is illustrated in FIG. 7. This embodiment does not contain a supplemental illumination device 13 or a kickstand 17. Also for this embodiment, the portable power source 10 can be configured to be either two or three D-cell batteries, which is sufficient electrical power for any typical industrial flashlight. The housing 8 near the plurality of illumination devices 1 has a flat face, which prevents this embodiment from rolling off of an even or uneven surface. In addition, this embodiment has a handle as its grasping member 22 and has a pocket clip 23 positioned opposition to the handle. This embodiment also has a wide band arc 7 of 170 degrees.

Figure 8:
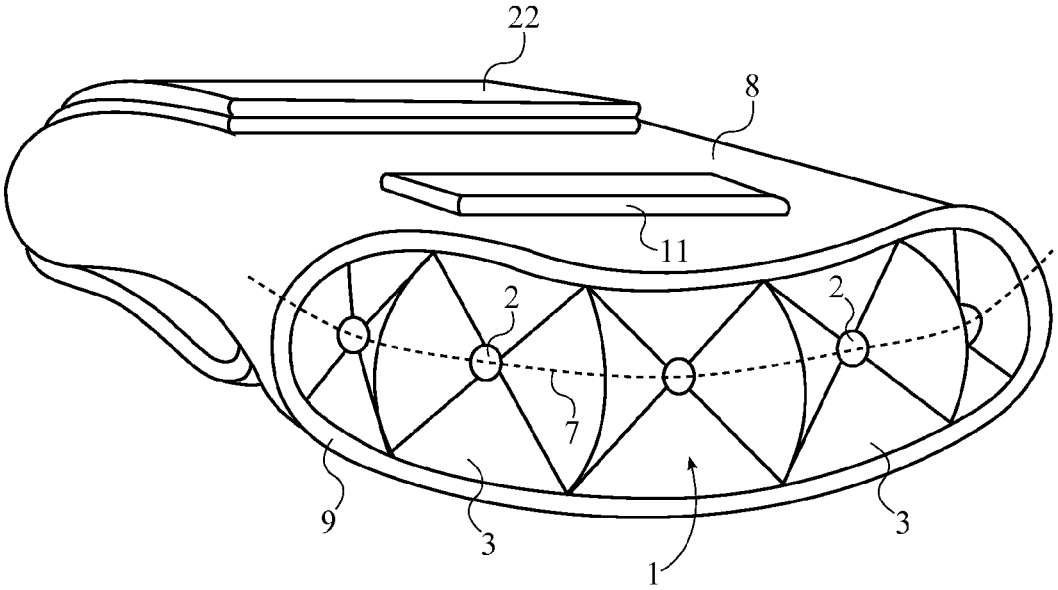
FIG. 8 is a perspective view of the tactical-flashlight embodiment of the present invention.

In another embodiment, the present invention is configured and shaped to be a tactical, hands-free, and light-weight flashlight, which is illustrated in FIG. 8. This embodiment does not contain a supplemental illumination device 13 or a kickstand 17. The portable power source 10 for this embodiment is three AA batteries. Also for this embodiment, the housing 8 and the grasping member 22 are designed to be attached to a user's shoulder, which allows the present invention to illuminate the direction that the user is facing. Consequently, the grasping member 22 is a strap assembly in this embodiment. A circular base is connected onto the bottom of the housing 8, and another circular plate is positioned parallel to the circular base and is rotatably connected to the circular base. Thus, the circular plate can concentrically rotate to the circular base. Both the circular plate and the circular base are configured to lock at 90 degree intervals. The strap assembly is connected to the circular plate and is typically wrapped around the shoulder strap of a bulletproof vest so that the strap assembly is perpendicular to the user's neck. A curve in the housing 8 allows this embodiment to be braced better by the user's shoulder and to be unobtrusive to the user. In addition, the wide band arc 7 is only 150 degrees for this embodiment.

Figure 9:
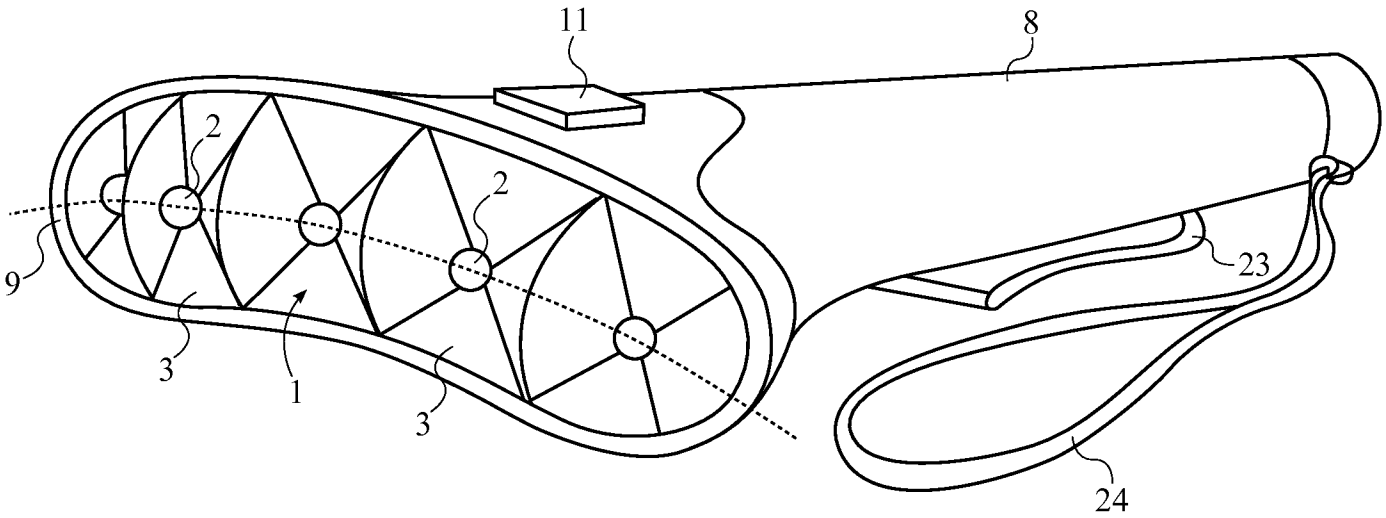
FIG. 9 is a perspective view of the miniaturized-flashlight embodiment of the present invention.

In another embodiment, the present invention is configured and shaped to be a miniaturized flashlight, which is illustrated in FIG. 9. This embodiment does not contain a grasping member 22, a supplemental illumination device 13, or a kickstand 17. This embodiment does have a pocket clip 23, which can be used to attach the present invention to the user's belt. The portable power source 10 for this embodiment is four AA batteries. In addition, the wide band arc 7 is 150 degrees for this embodiment. The housing 8 for this embodiment is also curved its longitudinal axis so that the housing 8 can properly brace the user's hip while hanging this embodiment of the present invention from the user's belt.

Although the invention has been explained in relation to its preferred embodiment, it is to be understood that many other possible modifications and variations can be made without departing from the spirit and scope of the invention as hereinafter claimed.

What is claimed is:

1. A wide-range portable illumination device comprises:
a plurality of illumination devices;
a housing;
a portable power source;
a transparent cover;
a primary switch;
a convex arcuate array of illumination devices arranged in a checkerboard pattern, each of said illumination devices comprises:
an outwardly facing light emitting diode (LED) bulb and a pyramidal case;
said pyramidal case comprises an apex and four of lateral panels;
each of said lateral panels comprises an inner reflective surface;
said lateral panels being positioned about said apex;
said LED bulb traversing into said pyramidal case through said apex;
said LED bulb being surrounded by said inner reflective surfaces for each of said lateral panels;
a plurality of curved panels tessellating with said illumination devices;
said arcuate array being mounted into said housing;
said transparent cover being positioned across said plurality of illumination devices;
said transparent cover being perimetrically connected to said housing;
said portable power source being positioned within said housing;
said portable power source being electrically connected to said plurality of illumination devices through said primary switch; and
said primary switch being operatively mounted into a first location on said housing.

2. The wide-range portable illumination device as claimed in claim 1 comprises:
an at least one phosphorescent strip; and
said phosphorescent strip being externally positioned onto said housing.

3. The wide-range portable illumination device as claimed in claim 1 comprises:
a supplemental illumination device; and
said supplemental illumination device being mounted into said housing opposite to said plurality of illumination devices.

4. The wide-range portable illumination device as claimed in claim 3 comprises:
an at least one interchangeable transparent cover with a colored tint;
said interchangeable transparent cover being positioned onto said supplemental illumination device; and
said interchangeable transparent cover being perimetrically attached to said housing, wherein said interchangeable transparent cover can be detached from said housing.

5. The wide-range portable illumination device as claimed in claim 3 comprises:
a supplemental power source;
a supplemental switch;
said supplemental power source being positioned within said housing;
said supplemental power source being electrically connected to said supplemental illumination device through said supplemental switch; and
said supplemental switch being bistably mounted into a second location on said housing, wherein the first and second locations are substantially spaced apart.

6. The wide-range portable illumination device as claimed in claim 1 comprises:
a kickstand;
said kickstand comprises a collapsible member and a plurality of notches;
said collapsible member comprises a first end and a second end;
said first end of said collapsible member being hingedly connected to said housing;
said collapsible member is adapted to fold to adjust a distance between said first and second ends;
said plurality of notches traversing into said housing;
said plurality of notches being serially positioned to each other adjacent to said first end of said collapsible member; and
one from said plurality of notches being engaged by said second end of said collapsible member.

7. The wide-range portable illumination device as claimed in claim 6, wherein said grasping member is a handle.

8. The wide-range portable illumination device as claimed in claim 6, wherein said grasping member is a strap assembly.

9. The wide-range portable illumination device as claimed in claim 1 comprises:
a grasping member; and
said grasping member being externally connected to said housing.

10. The wide-range portable illumination device as claimed in claim 1, wherein said primary switch is a three-stage luminosity switch.

11. The wide-range portable illumination device as claimed in claim 1 comprises:

a pocket clip; and said pocket clip being externally connected to said housing.

12. The wide-range portable illumination device as claimed in claim 11 comprises:

an at least one phosphorescent strip; and said phosphorescent strip being externally positioned onto said housing.

13. The wide-range portable illumination device as claimed in claim 11 comprises:

a supplemental illumination device;

a supplemental power source;

a supplemental switch;

an at least one interchangeable transparent cover with a colored tint;

said supplemental illumination device being mounted into said housing opposite to said plurality of illumination devices;

said interchangeable transparent cover being positioned onto said supplemental illumination device;

said interchangeable transparent cover being perimetrically attached to said housing, wherein said interchangeable transparent cover can be detached from said housing;

said supplemental power source being positioned within said housing;

said supplemental power source being electrically connected to said supplemental illumination device through said supplemental switch; and said supplemental switch being bistably mounted into a second location on said housing, wherein the first and second locations are substantially spaced apart.

14. The wide-range portable illumination device as claimed in claim 11 comprises:

a kickstand;

said kickstand comprises a collapsible member and a plurality of notches;

said collapsible member comprises a first end and a second end;

said first end of said collapsible member being hingedly connected to said housing;

said plurality of notches traversing into said housing;

said plurality of notches being serially positioned to each other adjacent to said first end of said collapsible member; and one from said plurality of notches being engaged by said second end of said collapsible member.

15. The wide-range portable illumination device as claimed in claim 11 comprises:

a grasping member; and said grasping member being externally connected to said housing.

16. The wide-range portable illumination device as claimed in claim 11 comprises:

a pocket clip; and said pocket clip being externally connected to said housing.

17. The wide-range portable illumination device as claimed in claim 11 comprises:

a hanging loop; and said hanging loop being externally linked to said housing.

18. The wide-range portable illumination device as claimed in claim 1 comprises:

a hanging loop; and said hanging loop being externally linked to said housing.

19. A wide-range portable illumination device comprises:

a plurality of illumination devices;

a housing;

a portable power source;

a transparent cover;

a primary switch;

a convex arcuate array of illumination devices arranged in a checkerboard pattern, each of said illumination devices comprises:

an outwardly facing light emitting diode (LED) bulb and a pyramidal case;

said pyramidal case comprises an apex and four of lateral panels;

each of said lateral panels comprises an inner reflective surface;

said lateral panels being positioned about said apex;

said LED bulb traversing into said pyramidal case through said apex;

said LED bulb being surrounded by said inner reflective surfaces for each of said lateral panels;

a plurality of curved panels tessellating with said illumination devices;

said arcuate array being mounted into said housing;

said transparent cover being positioned across said plurality of illumination devices;

said transparent cover being perimetrically connected to said housing;

said portable power source being positioned within said housing;

said portable power source being electrically connected to said plurality of illumination devices through said primary switch; and said primary switch being operatively mounted into said housing.

* * * * *